US006508091B1

(12) United States Patent
Donatini

(10) Patent No.: US 6,508,091 B1
(45) Date of Patent: Jan. 21, 2003

(54) CYLINDER LOCK WITH EFFRACTION-RESISTANT DEVICE

(75) Inventor: Livio Donatini, Faenza (IT)

(73) Assignee: Cisa S.p.A., Bologna (IT)

( * ) Notice: Subject to any disclaimer, the term of this patent is extended or adjusted under 35 U.S.C. 154(b) by 0 days.

(21) Appl. No.: 09/806,010

(22) PCT Filed: Oct. 11, 1999

(86) PCT No.: PCT/EP99/07611

§ 371 (c)(1),
(2), (4) Date: Mar. 26, 2001

(87) PCT Pub. No.: WO00/22263

PCT Pub. Date: Apr. 20, 2000

(30) Foreign Application Priority Data

Oct. 15, 1998 (IT) ..... BO98A0586

(51) Int. Cl.[7] ..... E05B 27/04

(52) U.S. Cl. ..... 70/359; 70/378; 70/407; 70/395

(58) Field of Search ..... 70/359, 378, 419, 70/493, 392, 358, 407, 409, 421, 395, 397, 398, 399

(56) References Cited

U.S. PATENT DOCUMENTS

| | | | | | |
|---|---|---|---|---|---|
| 1,095,500 | A | * | 5/1914 | Hansen | 70/359 |
| 4,823,575 | A | * | 4/1989 | Florian et al. | 70/358 |
| 4,854,146 | A | * | 8/1989 | O'Connell et al. | 70/277 |
| 4,905,489 | A | * | 3/1990 | Keller | 70/378 |
| 5,050,412 | A | * | 9/1991 | Errani | 70/358 |
| 5,123,268 | A | * | 6/1992 | Eizen | 70/359 |
| 5,437,176 | A | * | 8/1995 | Keller | 70/358 |
| 5,966,971 | A | * | 10/1999 | Keller | 70/359 |
| 6,125,674 | A | * | 10/2000 | Aramburu | 70/358 |
| 6,257,033 | B1 | * | 7/2001 | Ziv-Av | 70/409 |

FOREIGN PATENT DOCUMENTS

| | | | |
|---|---|---|---|
| AT | B- 395 262 | 11/1992 | |
| DE | B-11 22 866 | 1/1962 | |
| EP | A-0 472 495 | 2/1992 | |
| EP | A-0 899 398 | 3/1999 | |
| FR | 2312630 | * 12/1976 | 70/421 |
| GB | A-2 161 204 | 1/1986 | |

* cited by examiner

*Primary Examiner*—Anthony Knight
*Assistant Examiner*—John B. Walsh
(74) *Attorney, Agent, or Firm*—Guido Modiano; Albert Josif; Daniel O'Byrne

(57) ABSTRACT

A cylinder lock with a key, the lock having a plug with at least one hole intersecting the keyway. The hole is provided with two shoulders, one whereof lies further outward, the other one lying further inward with respect to the surface of the plug. An auxiliary tumbler is accommodated in the hole and comprises an auxiliary pin, an auxiliary complementary pin and a spring acting by expansion between the auxiliary pin and complementary pin. The tumbler can assume an elongated configuration, wherein the pin and the complementary pin are mutually spaced and axially offset angularly with respect to each other, or a shortened configuration, wherein they are aligned in mutual abutment without axially offset. The key has an elastic element adapted to cooperate with the auxiliary tumbler to allow, with the key inserted, compression thereof to the shortened configuration and disengagement from the notch and rotation of the plug.

7 Claims, 5 Drawing Sheets

CYLINDER LOCK WITH EFFRACTION-RESISTANT DEVICE

TECHNICAL FIELD

The present invention relates to a cylinder lock provided with an effraction-resistant device.

BACKGROUND ART

A cylinder lock conventionally comprises a body which has a cylindrical seat that rotatably accommodates a plug. A bit is rotationally rigidly coupled to one end of the plug for the actuation of a bolt or latch. A keyway is formed axially in the plug and intersects a first plurality of holes which are formed on a radial plane of the plug and in which a first plurality of pins is guided. The pins have conical ends which protrude into the keyway and on which the key is meant to act with a coded longitudinal portion thereof. A second plurality of holes, equal in number to the first plurality, is formed in the body so that each hole, in a specific angular position of the plug, is aligned with a respective pin. A plurality of complementary pins is guided in the second plurality of holes together with a plurality of springs which, in said specific angular position, keep each complementary pin in contact with a respective pin by acting on the plurality of complementary pins.

When the key is extracted from the keyway, the springs push the complementary pins and the pins into a position in which the complementary pins intersect the plane on which the seat and the plug mutually couple, preventing the rotation of the plug.

Viceversa, when the key is inserted, the plane of contact between the pins and the complementary pins is shifted until it lies on the coupling plane, allowing the plug to rotate.

The weak point of cylinder locks consists in that the pins can be accessed from outside through the front opening of the keyway and, by using adapted picking tools, can be moved fraudulently so as to allow the plug to turn.

In order to obviate fraudulent opening of cylinder locks with the above method, it has already been thought to arrange auxiliary tumblers which are accommodated in holes of the plug and which, when the appropriate key is used, remain inside the plug and do not prevent its rotation. Viceversa, if the key is forged, the auxiliary tumblers are pushed outward until they engage in notches of the plug seat so as to prevent its rotation. The effectiveness of the tumblers is due to the fact that if they are viewed from outside they cannot be distinguished from ordinary pins and therefore they can mislead the burglar. However, once these pins have been identified, they can be bypassed by providing appropriate longitudinal cutouts on the forged key (in this case one speaks of a "slotted key").

DISCLOSURE OF THE INVENTION

The aim of the present invention is to provide a lock in which the auxiliary tumblers and the key are structured so that the effectiveness of the auxiliary tumblers is not compromised by a forged slotted key.

Within the scope of this aim, an object of the present invention is to provide a lock in which the auxiliary tumblers are structured so as to neutralize attempts to open the lock when the key is not inserted.

This aim, this object and others which will become apparent hereinafter are achieved with a cylinder lock which comprises a body, a cylindrical seat formed in said body, a plug which can rotate in said seat, an actuation bit which is rotationally rigidly coupled to said plug, a keyway which is formed axially in said plug, characterized in that it comprises at least one hole which is formed in said plug and intersects said keyway, said hole being provided with two shoulders, of which one lies further outward and the other one lies further inward with respect to the surface of the plug, at least one auxiliary tumbler accommodated in said hole and comprising an auxiliary pin, an auxiliary complementary pin and a spring which acts by expansion between said auxiliary pin and complementary pin and is such as to allow said tumbler to assume an elongated configuration, wherein said pin and said complementary pin are mutually spaced and can be axially offset angularly with respect to each other, or a shortened configuration, in which said pin and said complementary pin are aligned in mutual abutment and cannot be axially offset, said tumbler, when the key is removed or when a forged key provided with a removed portion is inserted, being adapted to assume said elongated configuration by virtue of which said auxiliary pin is kept rested against said inner shoulder and said auxiliary complementary pin is kept at such a level as to allow angular strokes with respect to said auxiliary pin and the engagement of said complementary pin on said outer shoulder, while the end of said complementary pin remains engaged in a notch of said cylindrical seat, and further characterized in that said key is provided with an elastic element adapted to cooperate with said auxiliary tumbler in order to allow, when the key is inserted, the compression of said auxiliary tumbler in the shortened configuration and the disengagement of said tumbler from said notch and the consequent rotation of said plug.

BRIEF DESCRIPTION OF THE DRAWINGS

Further characteristics and advantages of the present invention will become apparent from the following detailed description and on the basis of the accompanying drawings, wherein.

WAYS OF CARRYING OUT THE INVENTION

Figure 2:
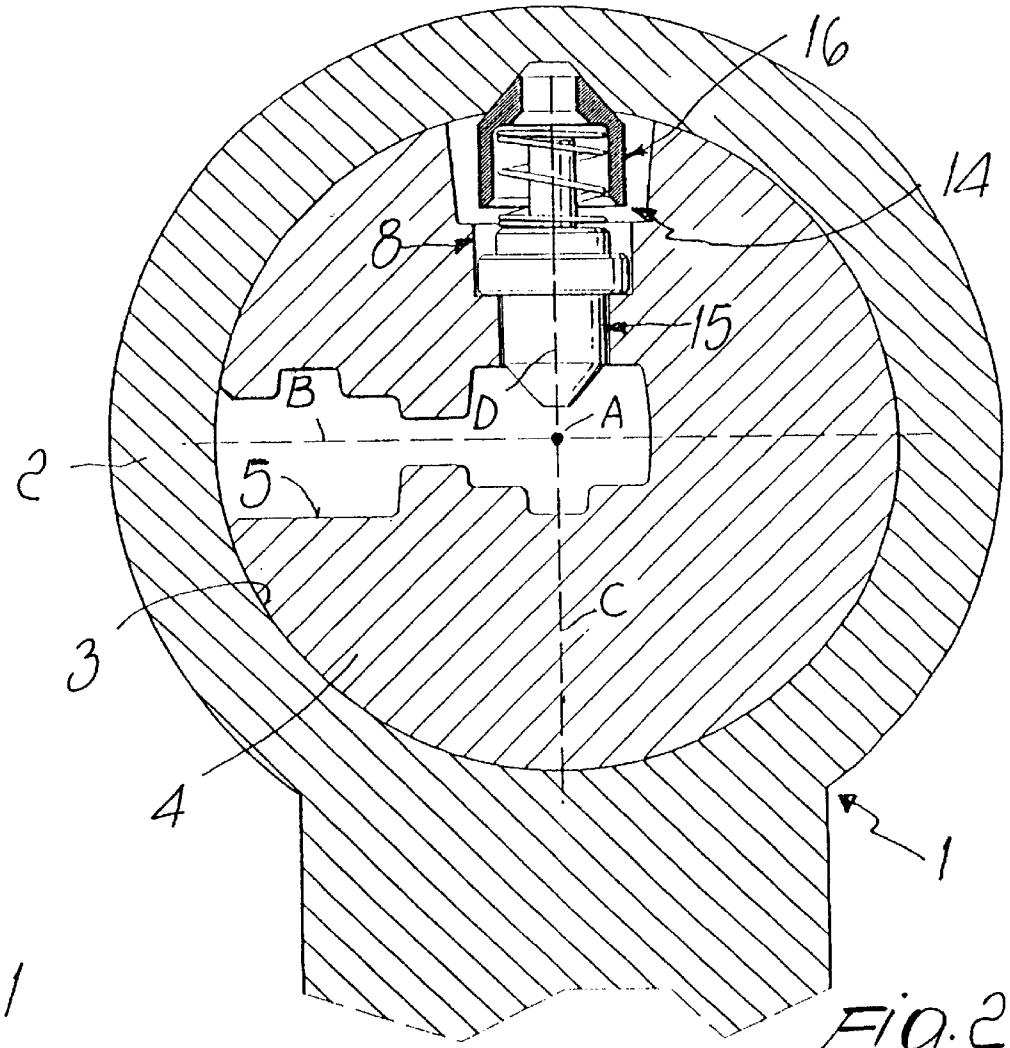
FIG. 2 is a sectional transverse view of the cylinder lock, taken in the region of the auxiliary tumbler.
Figure 1:
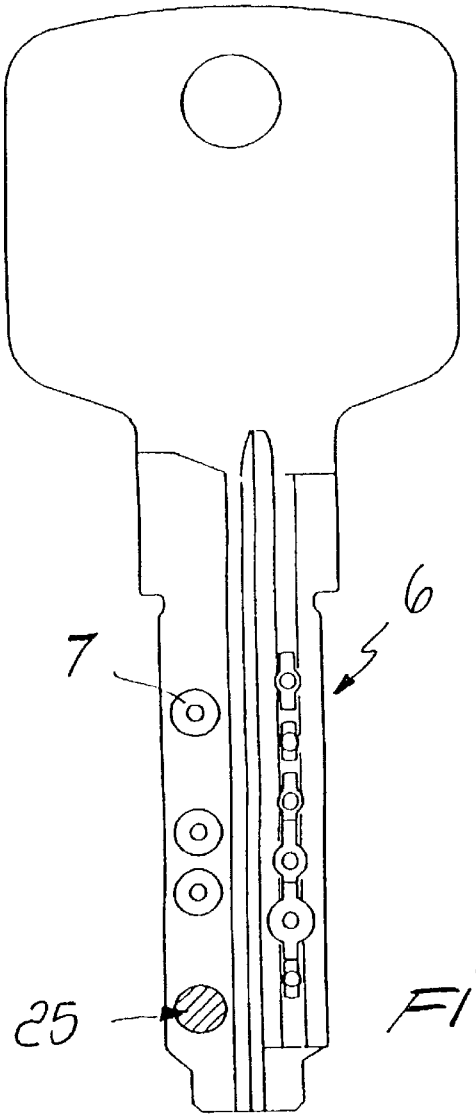
FIG. 1 is a front view of a flat-blade key.

With reference to FIGS. 1 to 4, the lock comprises a body 1 which is composed of a tubular portion 2 which forms a cylindrical seat 3 for a plug 4 rotatable about the longitudinal axis A.

A bit (not shown) for the actuation of a bolt or latch is rotationally coupled in a known manner to the plug 4.

A keyway 5 is formed in the plug 4 for the insertion of a flat-blade key 6. In a known manner, the flat-blade key 6 (see FIG. 1) has, on its opposite faces, respective pluralities of conical notches 7 which are suitable to receive the ends of the pins which, in cooperation with respective complementary pins, form the tumblers for rotationally locking the plug 4 in the seat 3 when the key is extracted. The tumblers are not shown because they are fully conventional and irrelevant to the inventive concept of the present invention.

The keyway 5 and the axes of the notches 7 lie on radial planes B and C which are mutually perpendicular and pass through the axis A. In the cylinder 4 there is provided a hole 8 along a radial axis D which is perpendicular to the axis A and lies on the plane C; said hole has annular shoulders 9 and 10. Said annular shoulders 9, 10 are, respectively, internal and external with respect to the axis A and divide the hole 8 into three portions 11, 12 and 13 of increasing diameter from the inside outward. The portions 11 and 12 are cylindrical, whereas the outermost portion 13 has a flared shape starting from the shoulder 10.

The hole 8 accommodates an auxiliary blocking tumbler 14 which is adapted to prevent the rotation of the plug 4 if a forged or tampered key is inserted in the keyway 5.

The tumbler 14 is composed of a pin 15 and of a complementary pin 16 which are actuated to expand by a cylindrical spring 17 interposed between them.

The pin 15 comprises a cylindrical tang 15*a* which is guided in the portion 11 of the hole 8 and ends with a conical point 18 which protrudes toward the axis A and enters the keyway 5.

On the opposite side with respect to the point 18, the pin 15 has a collar 19, from which an annular region 20 having a smaller diameter protrudes, and a stem 21 which is smaller in diameter than the annular region 20.

The complementary pin 16 is shorter than the portion 13 of the hole 8 and is constituted by a bush 16*a* whose outside diameter is smaller than the diameter of the collar 19 and whose inside diameter is slightly greater than the diameter of the annular region 20. In this manner, the complementary pin can be centered on the annular region 20, abutting against the collar 19.

On the opposite side, the complementary pin 16 has a conical point 22 which is centrally crossed by a hole 23 suitable to receive the end of the stem 21. A chamber is formed between the stem 21 of the pin 15 and the bush 16*a* of the complementary pin 16 and accommodates the spring 17; one end of said spring abuts against the annular region 20 and the opposite end abuts against a raised portion 22*a* formed inside the conical point 22.

It should be noted that the sum of the lengths of the tang 15, of the point 18 and of the collar 19 in the direction D is greater than the sum of the lengths of the portions 11 and 12 of the hole 8. In this manner, when the point 18 is flush with the internal face of the keyway 5, the upper face of the collar 19, i.e., the face from which the annular region 20 protrudes, lies beyond the shoulder 10 in the portion 13 of the hole 8.

The point 22 of the complementary pin 16 is suitable to engage in a conical notch 24 formed in the seat 3 in alignment with the axis D. The notch 24 has a taper which is complementary to the taper of the point 22 and allows the disengagement of the point when the plug 4 is turned with respect to the body 2.

The tumbler 14 is conveniently located at the end of the keyway 5 with respect to the opening for inserting the key 6; once the key is inserted, it acts on the tumbler 14 by means of an elastic element with which it is provided.

The elastic element is constituted by a cylindrical pad 25 which is guided in a blind recess 26 formed in the key 6 and is prevented from leaving it by a lip 27 of the rim of the recess. The pad 25 has a cavity 28 which is open toward the bottom of the recess 26 and accommodates a spring 29 which acts between the pad and the bottom; the recess keeps the pad in abutment against the lip 27. In this abutment position, the outer face of the pad 25, i.e., the face that lies opposite the face engaged by the spring 29, protrudes slightly from the upper face of the key. Conveniently, the outer face of the pad has a peripheral rounded region 30 which prevents the pad 25 from jamming during the insertion of the key in the keyway 5.

The spring 29 has a higher elastic coefficient than the spring 17 of the auxiliary tumbler 14 and compresses the latter when the pad 25 is aligned with the tumbler 8.

Operation of the described lock is as follows. When the key is extracted, as shown in FIG. 2, the auxiliary tumbler 14 has its opposite points 22 and 18 engaged in the notch 24 and in the keyway 5, respectively.

Figure 3:
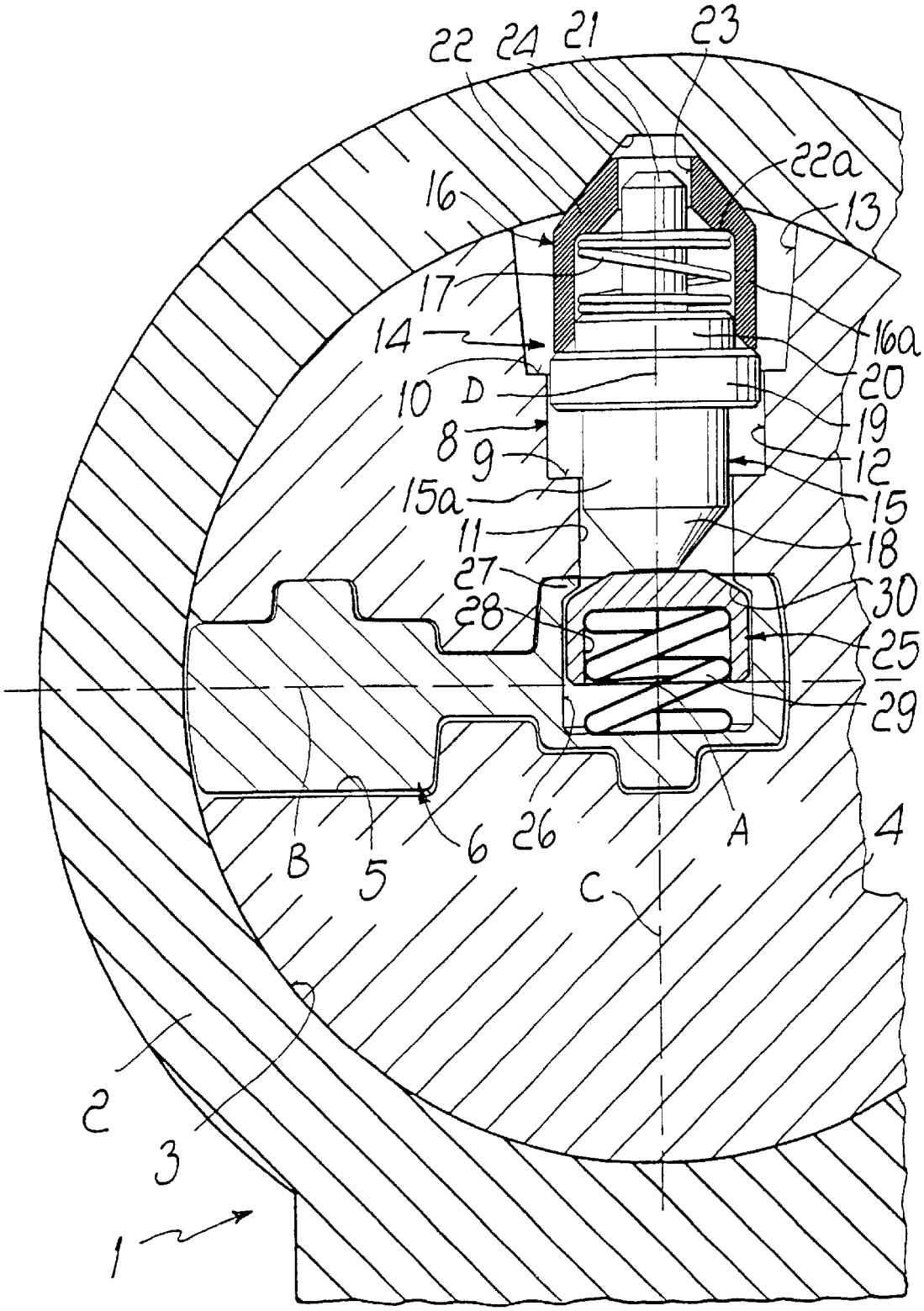
FIG. 3 is an enlarged-scale partial sectional view of the lock with a correct key in the inserted position.
Figure 4:
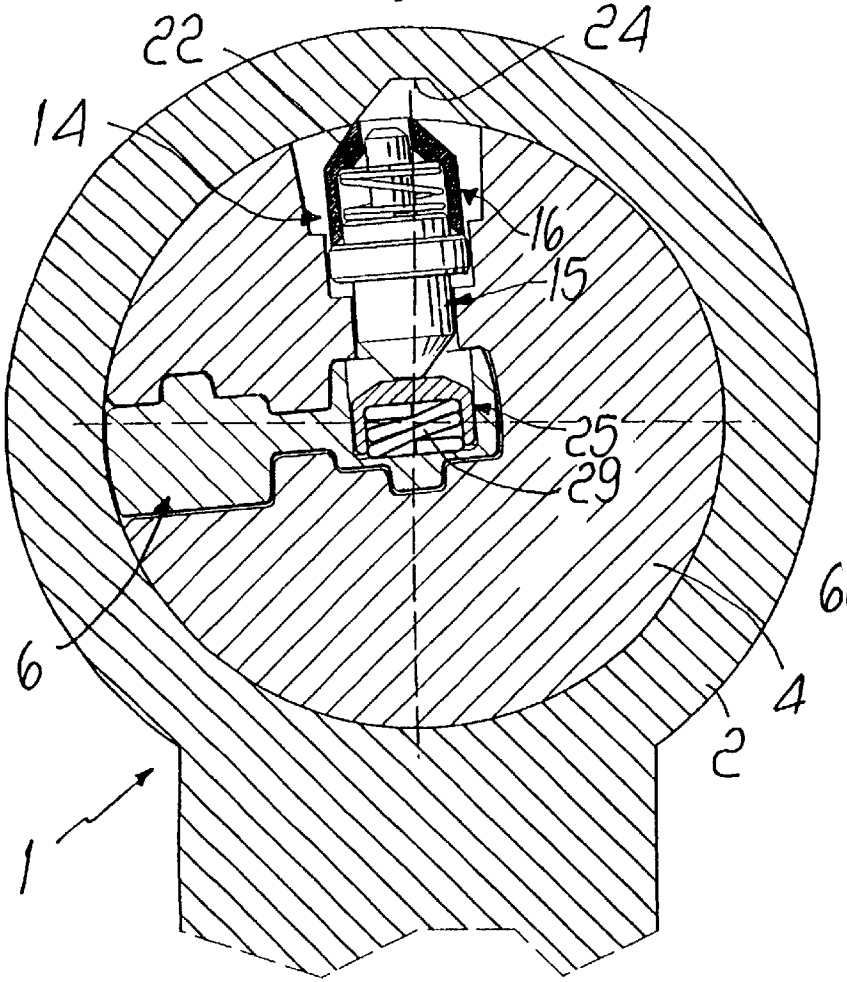
FIG. 4 is a transverse sectional view of the lock with a correct key in the rotated position.

By inserting the correct key 6, the tumbler 14 aligns with the pad 25 which, due to the higher elastic coefficient of the spring 29, produces the penetration of the stem 21 in the hole 23 of the complementary pin 16 until the collar 19 abuts against the edge of the bush 16*a* of the complementary pin 16, as shown in FIG. 3. In this position, by way of the rotation of the key 6 the conical surfaces of the point 22 of the complementary pin 16 and of the notch 24 generate an axial component which is directed toward the axis A and causes the compression of the spring 29 and the retraction of the tumbler 14 into the hole 8 until the point 22 of the complementary pin 16 disengages from the notch 24, allowing the rotation of the plug 4. This situation is shown in FIG. 4.

Figure 5:
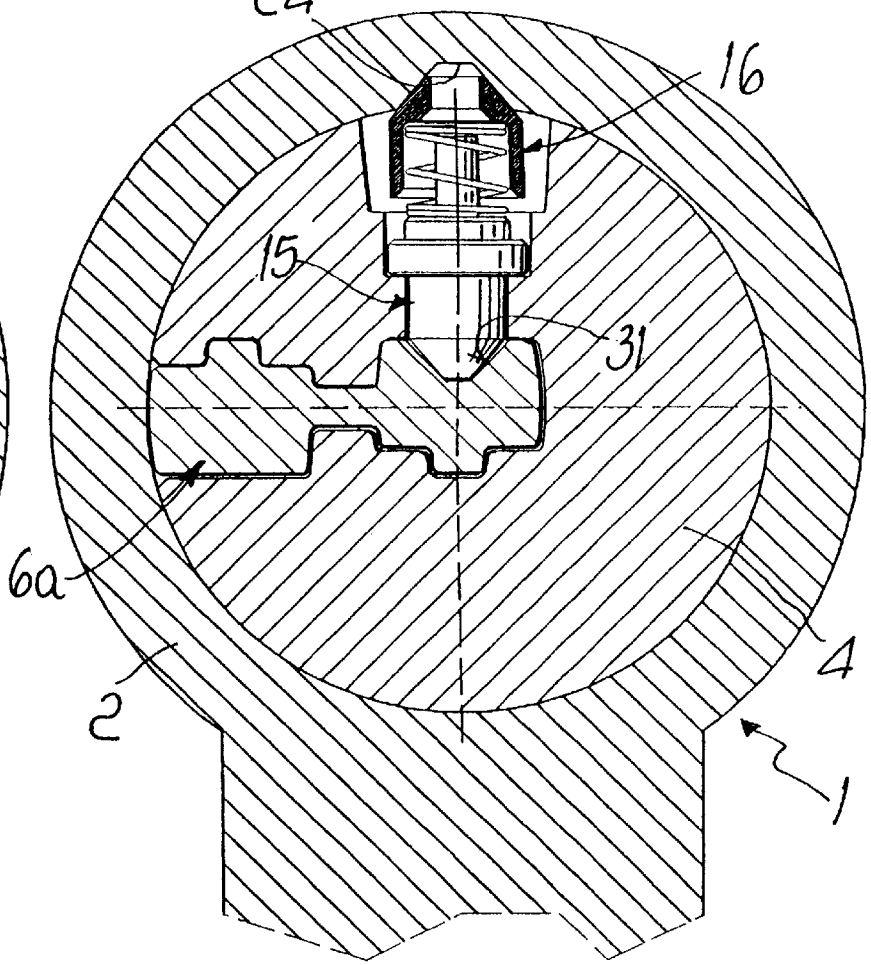
FIG. 5 is a transverse sectional view of the lock with a key that has been tampered with by removing a longitudinal portion, in the inserted position.

If instead, during an effraction attempt, one inserts in the keyway 5 a forged key 6*a* (see FIG. 5) provided with a longitudinal recess 31 provided fraudulently under the assumption of dealing with a conventional auxiliary tumbler (i.e., a tumbler which is as long as the tumbler 14 but cannot be compressed because it is constituted by a single pin whose conical opposite ends cooperate with respective notches of the seat 3 and of the key and therefore can be neutralized by providing a cutout in the key), rotation of the plug 4 is blocked. In this case, the situation shown in FIG. 5 in fact occurs in which the pin 15 and the complementary pin 16 remain spaced so that the points 18 and 22 engage in the recess 31 and in the notch 24 and the stem 21 is disengaged from the hole 23.

Figure 6:
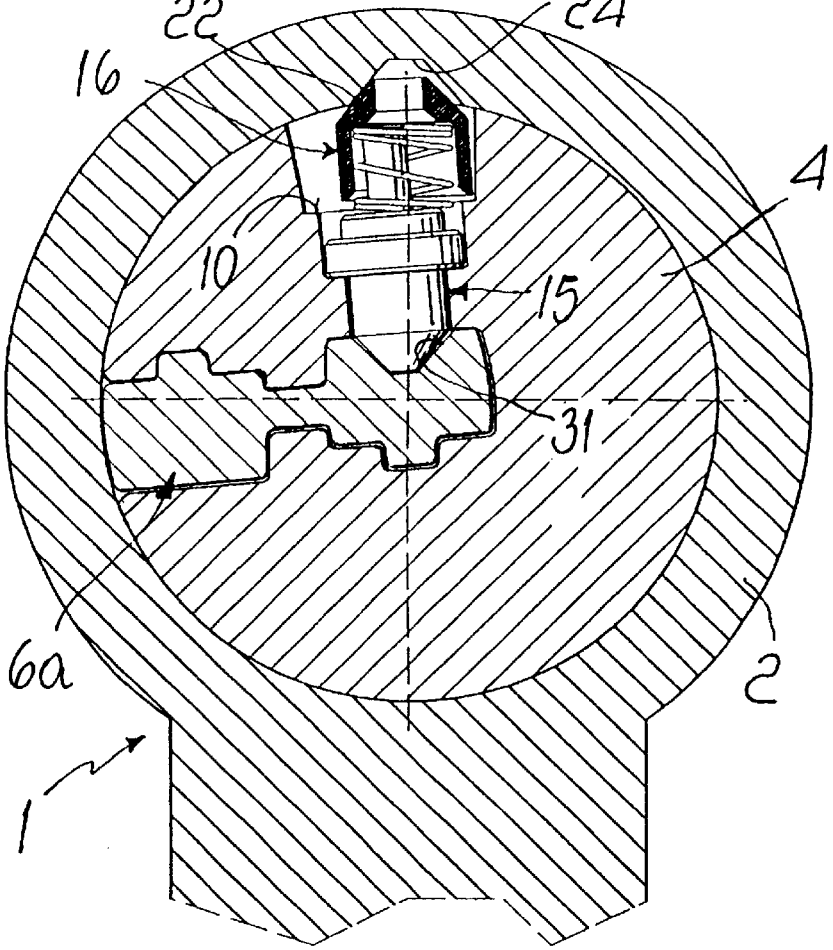
FIG. 6 is a transverse sectional view of the lock with the key of FIG. 6 in the rotated position.

In this situation, if the plug 4 is turned the pin 15 becomes angularly axially offset with respect to the complementary pin 16 and the complementary pin 16 moves radially and abuts, with the inner rim of the bush 16*a*, against the shoulder 10 (see FIG. 6). Since the complementary pin 16 is longer than the portion 13 of the hole 8, the point 22 of the complementary pin 16 does not leave the notch 24 completely and blocks the further rotation of the plug 4, thwarting the attempted effraction with a slotted key.

Figure 7:
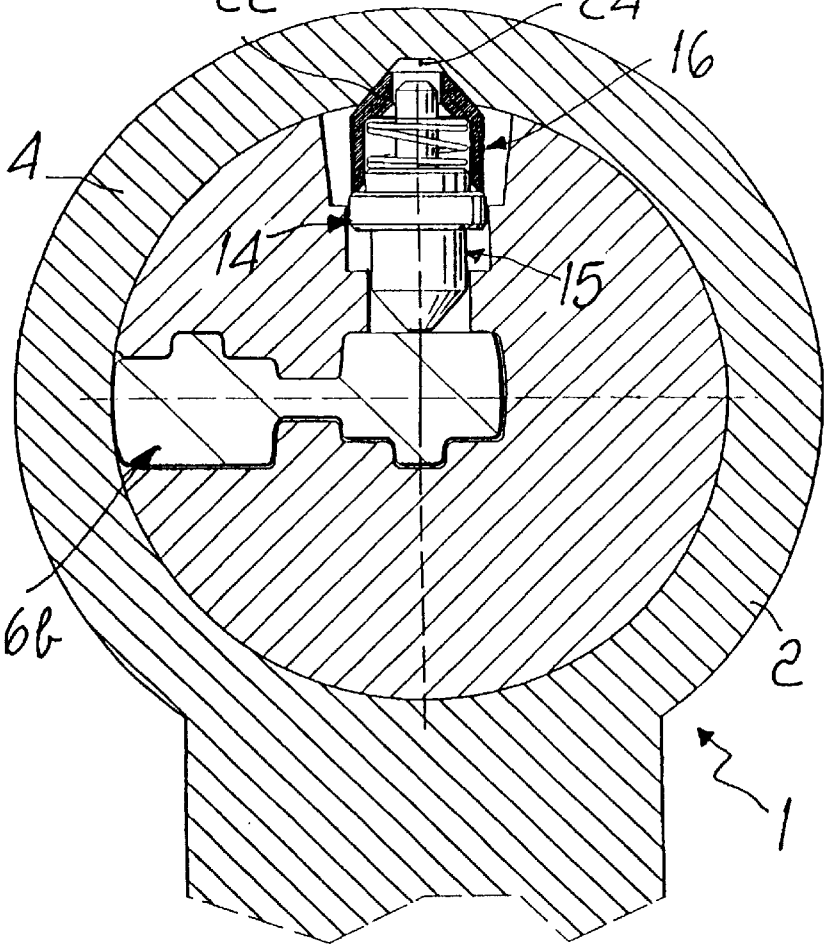
FIG. 7 is a transverse sectional view of the lock with a forged key in the inserted position.

If instead the forged key has not been slotted as shown by 6*b* in FIG. 7, the pin 15 is pushed by the key into the complementary pin 16 until the collar 19 abuts against the lower rim of the bush 16*a* of the complementary pin 16 and the stem 21 engages in the hole 23 of the point 22. In this compressed position, the tumbler 14 has a total length which is greater than that of the hole 8, and therefore the point 22 remains engaged in the notch 24 and prevents the rotation of the plug.

It is evident that the lock allows to achieve the intended aim and object. The point 18 that remains visible when viewing the keyway 5 axially in fact does not allow potential burglars to recognize the type of auxiliary tumbler and therefore to prepare a key capable of neutralizing it. The forged key, regardless of whether it is slotted or not, in fact acts on the tumbler so as to move it in any case to a position which blocks the plug.

The invention is susceptible of numerous modifications and variations.

Figure 8:
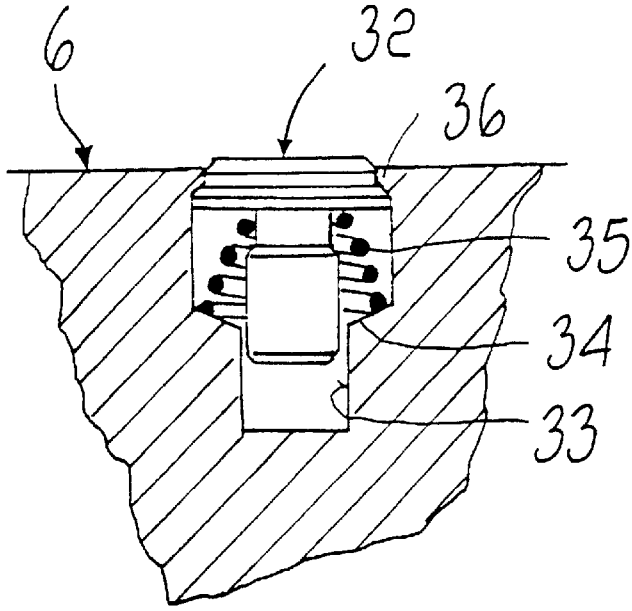
FIG. 8 is a sectional view of a detail of a key according to a first different embodiment; and finally

FIG. 8 illustrates an embodiment in which the elastic element of the key is constituted by a pin 32 which is guided in a recess 33 of the key 6.

The pin is mushroom-shaped, with a stem which is surmounted by a head which constitutes the pad of the preceding example. The recess 33 has a variation in diameter which forms a shoulder 34 against which a conical spring 35 rests; the spring acts on the pin 32 and actuates it into abutment against a lip 36 of the rim of the recess 33.

In another embodiment of the invention, auxiliary tumblers are provided on one or both of the sides of the keyway.

Figure 9:
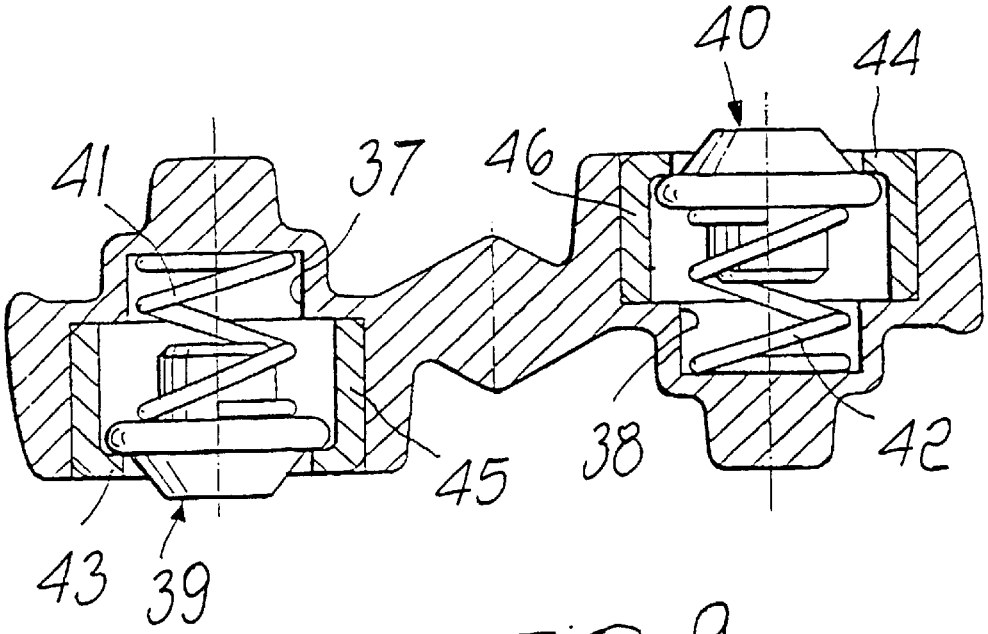
FIG. 9 is a sectional view of a key according to still another embodiment.

FIG. 9 illustrates a key for operating tumblers arranged on both sides of the keyway. The key 6 comprises two recesses 37 and 38 in which respective pins 39 and 40 are guided; said pins are mushroom-shaped and are actuated by respective conical springs 41, 42 against abutments 43, 44 constituted by the inward-folded rim of bushes 45, 46 which are forced into the recesses 37 and 38.

The invention can of course be used not only in locks that use a flat-blade key but also in profiled-key locks and the tumblers can be arranged so as to be actuated by elastic elements arranged on the edge of the key.

The disclosures in Italian Patent Application No. BO98A000586 from which this application claims priority are incorporated herein by reference.

What is claimed is:

1. A cylinder lock and a key insertable therein, the lock comprising: a body; a cylindrical seat formed in said body and having a notch; a plug which can rotate in said seat, an actuation bit which is rotationally rigidly coupled to said plug; a keyway which is formed axially in said plug, comprising at least one hole which is formed in said plug and intersects said keyway, said hole being provided with two shoulders, of which one lies further outward and the other one lies further inward with respect to a surface of the plug; at least one auxiliary tumbler accommodated in said plug hole and comprising an auxiliary pin; an auxiliary complementary pin; a spring arranged so as to act by expansion between said auxiliary and complementary pins and so as to allow said tumbler to assume any of an elongated configuration, wherein said pin and said complementary pin are spaced from each other and axially offset angularly with respect to each other, and a shortened configuration, in which said pin and said complementary pin are aligned in mutual abutment without being axially offset and wherein, said tumbler, in a configuration with any of the key removed and with a forged key with a removed portion inserted, being adapted to assume said elongated configuration in which said auxiliary pin is kept rested against said inward shoulder and said auxiliary complementary pin is kept at such a level as to allow angular strokes with respect to said auxiliary pin and the engagement of said complementary pin on said outward shoulder, while an end of said complementary pin remains engaged in the notch of said cylindrical seat; and wherein said key is provided with an elastic element adapted to cooperate with said auxiliary tumbler in order to allow, with the key inserted, compression of said auxiliary tumbler in the shortened configuration and disengagement of said tumbler from said notch and the consequent rotation of said plug.

2. The lock and key of claim 1, wherein said key comprises a recess with a lip at a rim thereof and a spring, said elastic element of the key being constituted by a cylindrical pad which is guided in the recess of the key and has a cavity which accommodates said spring which acts between said pad and a bottom part of said recess and actuates said pad against the lip of the rim of said recess.

3. The lock and key of claim 2, wherein the rim of said pad has a peripheral rounded region.

4. The lock and key of claim 1, wherein said key comprises a recess with a lip at a rim thereof, said elastic element being constituted by a mushroom-shaped pin which comprises a stem, a pad, and a spring thereof acts against said pad, and which keeps said pad actuated against the lip of the rim of said recess.

5. The lock and key of claim 2, wherein said key comprises a bush which is forced into said recess, said lip being constituted by an inward-folded rim of said bush.

6. The lock and key of claim 1, wherein said two shoulders are annular, said plug hole for said auxiliary tumbler being divided by said two annular shoulders into three portions having diameters which increase from the inside outward, an innermost portion of said plug hole leading into said keyway, and an outer one being flared toward a peripheral surface of the plug; and wherein said auxiliary tumbler comprises: a tumbler pin which has a cylindrical tang guided in said innermost portion of said plug hole and having, at one end, a conical point which protrudes into the keyway and, at an opposite end, a collar which is guided in the intermediate portion that connects said internal portion of said plug hole to said flared outer portion, an annular region, and a guiding stem for said complementary pin protruding axially from said collar.

7. The lock and key of claim 6, wherein said complementary pin is constituted by a bush with a conical point thereof adapted to engage in the notch of said cylindrical seat which is conical and shaped complementarily thereto, said conical point being crossed by a hole for accommodating said stem, and a spring, said stem and said bush forming a chamber for accommodating said spring of the complementary pin which acts between said annular region and said conical point of the tumbler pin.

* * * * *